US012807352B2

(12) United States Patent
You et al.

(10) Patent No.: US 12,807,352 B2
(45) Date of Patent: Nov. 24, 2026

(54) AUXILIARY DEVICE FOR REUSABLE COFFEE CAPSULES

(71) Applicant: Shenzhen Mingyangpinhui Trading Co., LTD., Shenzhen (CN)

(72) Inventors: Xueming You, Shenzhen (CN); Shuling Ye, Foshan (CN)

(73) Assignee: Shenzhen Mingyangpinhui Trading Co., LTD., Shenzhen (CN)

( * ) Notice: Subject to any disclaimer, the term of this patent is extended or adjusted under 35 U.S.C. 154(b) by 0 days.

(21) Appl. No.: 19/214,615

(22) Filed: May 21, 2025

(65) Prior Publication Data

US 2026/0326950 A1 Oct. 22, 2026

(30) Foreign Application Priority Data

Apr. 16, 2025 (CN) ..... 202520732493.1

(51) Int. Cl.
*B65B 29/02* (2006.01)
*B65B 61/06* (2006.01)
*B65B 67/02* (2006.01)

(52) U.S. Cl.
CPC ..... *B65B 29/022* (2017.08); *B65B 61/06* (2013.01); *B65B 67/02* (2013.01)

(58) Field of Classification Search
CPC ..... B65B 29/022; B65B 61/06; B65B 67/02; B65B 1/24; B65B 7/2821; B65D 85/8052; A47J 31/0642; A47J 31/0689
See application file for complete search history.

(56) References Cited

U.S. PATENT DOCUMENTS 2,046,367 A * 7/1936 Collins ..... B65B 1/24 426/414
2,181,945 A * 12/1939 Komarik ..... B65B 1/24 141/390
2,524,243 A * 10/1950 Wicklund ..... B65B 67/02 141/342
2,626,738 A * 1/1953 Nordquist ..... B65B 1/24 222/386
2,693,752 A * 11/1954 Garapolo ..... B30B 15/16 100/269.12
3,748,819 A * 7/1973 Christensson ..... B65B 43/50 53/527
4,147,014 A * 4/1979 Tashiro ..... B29C 51/32 53/563
4,338,765 A * 7/1982 Ohmori ..... B65D 3/06 53/471
4,957,753 A * 9/1990 Bardsley ..... B65B 1/24 220/624
5,168,794 A * 12/1992 Glucksman ..... A47J 31/465 99/305
5,445,562 A * 8/1995 Brunell ..... A22C 7/0046 100/283

(Continued)

*Primary Examiner* — Dariush Seif
(74) *Attorney, Agent, or Firm* — Ricky Lam

(57) ABSTRACT

An auxiliary device for reusable coffee capsules is provided, comprising: a base; a powder pressing unit comprising a capsule groove arranged on the base, a funnel detachably connected to the capsule groove, and a powder pressing cylinder for compacting coffee powder; a film pressing unit; and a cutting unit comprising a cutting body and multiple cutting teeth extending away from the cutting body and spaced apart.

17 Claims, 6 Drawing Sheets

(56) References Cited

U.S. PATENT DOCUMENTS 5,496,573 A * 3/1996 Tsuji ..... B01D 39/163 426/433
5,520,105 A * 5/1996 Healy ..... B30B 1/24 99/545
5,526,733 A * 6/1996 Klawuhn ..... A47J 31/3671 99/287
5,584,239 A * 12/1996 Yelczyn ..... B30B 9/321 100/902
5,618,570 A * 4/1997 Banks ..... A47J 31/20 99/287
5,637,335 A * 6/1997 Fond ..... B65D 85/8043 426/77
D386,503 S * 11/1997 Emerson ..... D15/123
5,722,313 A * 3/1998 Schmed ..... A47J 31/3614 99/289 R
5,809,867 A * 9/1998 Turner ..... A47J 31/20 99/287
5,897,899 A * 4/1999 Fond ..... A47J 31/3695 426/77
5,941,055 A * 8/1999 Coates ..... B65B 61/20 425/134
6,260,475 B1 * 7/2001 Tegel ..... B30B 1/04 99/287
6,481,338 B1 * 11/2002 Wai ..... A47J 31/0663 99/302 R
6,832,542 B2 * 12/2004 Hu ..... A47J 31/0673 99/302 R
8,051,766 B1 * 11/2011 Yu ..... A47J 31/20 99/287
8,479,638 B2 * 7/2013 Leung ..... A47J 31/44 99/302 R
8,927,037 B2 * 1/2015 Kihnke ..... A47J 31/0673 426/77
9,232,872 B2 * 1/2016 Rivera ..... A47J 31/0689
9,586,709 B1 * 3/2017 Rivera ..... B65B 7/28
9,695,027 B2 * 7/2017 Magniet ..... B65D 85/8052
10,518,965 B2 12/2019 Garcin et al.
11,174,052 B2 * 11/2021 Mesa Gonzalez .... B65B 29/022
11,369,226 B2 * 6/2022 Rivera ..... B65D 85/8043
12,304,675 B1 * 5/2025 Liu ..... B65B 1/02
2002/0078831 A1 * 6/2002 Cai ..... A47J 31/14 99/295
2003/0096038 A1 * 5/2003 Cai ..... A47J 31/14 426/77
2004/0206243 A1 * 10/2004 Foster ..... A47J 31/44 99/279
2005/0132890 A1 * 6/2005 Constantine ..... A47J 31/44 99/275
2007/0132164 A1 * 6/2007 Petiziol ..... A47J 31/44 267/133
2007/0144357 A1 * 6/2007 Rivera ..... A47J 31/08 99/295
2007/0163122 A1 * 7/2007 Grosh ..... B26B 5/001 30/2
2007/0196551 A1 * 8/2007 Campetella ..... A47J 31/3609 426/438
2008/0299262 A1 * 12/2008 Reati ..... B65B 61/20 83/84
2011/0162533 A1 * 7/2011 Fumagalli ..... A47J 31/3695 99/295
2012/0269933 A1 * 10/2012 Rapparini ..... B65D 85/812 206/0.5
2013/0139699 A1 * 6/2013 Rivera ..... B65D 85/8061 99/295
2013/0167729 A1 * 7/2013 Hoare ..... A47J 31/4464 99/287
2014/0150616 A1 * 6/2014 Zanetti ..... A47J 31/407 83/111
2014/0290493 A1 * 10/2014 Rivera ..... A47J 31/407 99/295
2015/0056331 A1 * 2/2015 Rivera ..... B65D 85/8052 99/287
2015/0135968 A1 * 5/2015 Gort-Barten ..... A47J 31/0647 99/295
2016/0145038 A1 * 5/2016 Apone ..... A47J 42/46 53/445
2016/0157661 A1 * 6/2016 Torquemada ..... A47J 31/0657 99/323
2016/0257488 A1 * 9/2016 de Graaff ..... A47J 31/0678
2016/0257548 A1 * 9/2016 Rivera ..... B67C 11/02
2016/0297659 A1 * 10/2016 Minnier ..... B67B 7/24
2017/0119198 A1 * 5/2017 Barber ..... A47J 31/0642
2017/0360057 A1 * 12/2017 Rivera ..... A47J 43/281
2017/0360239 A1 * 12/2017 Rivera ..... A47J 31/0689
2017/0361961 A1 * 12/2017 Rivera ..... A47J 31/0689
2020/0189772 A1 * 6/2020 Rivera ..... B65B 29/022
2021/0253334 A1 * 8/2021 Rivera ..... A23F 5/262
2021/0345815 A1 * 11/2021 Bombeck ..... A47J 31/0663
2022/0009661 A1 * 1/2022 Rivera ..... B65B 1/24
2022/0053965 A1 * 2/2022 Caillenton ..... A47J 31/18
2022/0355959 A1 * 11/2022 Liu ..... B30B 1/00
2023/0172387 A1 * 6/2023 Hsieh ..... B26B 27/00
2023/0227187 A1 * 7/2023 Bartoli ..... B65B 51/225 53/477
2024/0336383 A1 * 10/2024 Liu ..... B65B 29/022
2025/0282529 A1 * 9/2025 Zhao ..... B65B 7/28
2025/0344896 A1 * 11/2025 Levi ..... A47J 31/0626

* cited by examiner

AUXILIARY DEVICE FOR REUSABLE COFFEE CAPSULES

CLAIMS OF PRIORITY

This patent application claims priority from:

(1) CN utility model patent application number is 2025207324931 with a filing date of Apr. 16, 2025 and DAS code of 8FAA.

FIELD

The present disclosure relates to the technical field of daily necessities, and more specifically, to an auxiliary device for reusable coffee capsules.

BACKGROUND

Coffee capsules can preserve coffee flavor and extend shelf life by sealing ground coffee powder in an inert gas environment. However, the economic and environmental issues brought by their disposable property are becoming increasingly prominent. At present, coffee capsules on the market are made of aluminum-plastic composite materials. Although the cup body remains intact during the extraction process, the aluminum sealing film designed to ensure sealing is damaged after high-temperature and high-pressure puncture. Each capsule costing 1-3 dollars is used only once, causing serious resource waste. This contradiction has given rise to the research and development demand for reusable coffee capsules, with the key being to break through the technological constraints of traditional capsules being "disposable". The auxiliary device for reusable coffee capsules provided by the present disclosure can efficiently apply film, compact coffee powder, accurately cut, and ensure the sealing of the film.

SUMMARY

The technical problem solved by the present disclosure is the resource waste problem of the existing "disposable" coffee capsule, and how to simultaneously consider the problems of film applying, compacting coffee powder, accurately cutting, and ensuring the sealing of film using the auxiliary device of reusable coffee capsules.

In view of the above and other ideas, the present disclosure is proposed.

According to one aspect of the present disclosure, there is provided an auxiliary device for reusable coffee capsules, comprising:

- a base;
- a powder pressing unit comprising a capsule groove arranged on the base, a funnel detachably connected to the capsule groove, and a powder pressing cylinder for compacting coffee powder;
- a film pressing unit; and
- a cutting unit comprising a cutting body and multiple cutting teeth extending away from the cutting body and spaced apart.

In one embodiment, wherein the film pressing unit comprises a first film pressing structure arranged on the base and a second film pressing structure arranged on the funnel and matched with the first film pressing structure.

In one embodiment, wherein the first film pressing structure comprises a first limiting groove and a first convex surface extending away from the base.

In one embodiment, wherein the second film pressing structure comprises a first limiting wing matched with the first limiting groove and a second convex surface arranged opposite to the first convex surface.

In one embodiment, wherein the funnel further comprises a first opening and a second opening arranged opposite to the first opening, and the first opening and the second opening are connected to the capsule groove.

In one embodiment, wherein an inner diameter of the first opening is greater than an inner diameter of the second opening.

In one embodiment, wherein the powder pressing cylinder comprises a powder pressing plane and a limiting flange.

In one embodiment, wherein a diameter of the powder pressing plane is smaller than the inner diameter of the second opening.

In one embodiment, wherein the difference between the diameter of the powder pressing plane and the inner diameter of the second opening is within the range of 1-3 mm.

In one embodiment, wherein an edge of the capsule groove is circular, and the first film pressing structure is arranged around the capsule groove.

In one embodiment, wherein the second opening is circular, and the second film pressing structure is arranged around the second opening.

In one embodiment, wherein the cutting teeth are arranged on an edge of a circle.

In one embodiment, wherein the cutting body comprises a second limiting wing and a first avoidance groove.

In one embodiment, wherein the first limiting groove matches the second limiting wing, and the first convex surface matches the first avoidance groove.

In one embodiment, wherein a first positioning column is further provided in the first limiting groove, and a first positioning hole matching the first positioning column is further provided in the second limiting wing.

In one embodiment, wherein the cutting unit further comprises multiple positioning protrusions spaced apart, and the multiple positioning protrusions are arranged on an edge of a circle.

In one embodiment, wherein the base is provided with a storage groove for accommodating the cutting unit, and the storage groove is provided with a third convex surface and a first avoidance hole.

In one embodiment, wherein the cutting unit is provided with a first groove that matches the third convex surface.

In one embodiment, wherein the storage groove is provided with a magnet for attracting the third convex surface and the first groove together.

In one embodiment, wherein the storage groove is set at the bottom of the base.

The auxiliary device for reusable coffee capsules provided by the present disclosure can efficiently apply film, compact coffee powder, accurately cut, and ensure the sealing of the film. By using this auxiliary device for reusable coffee capsules, it is possible to repeatedly apply sealing film to the coffee capsules, making them reusable and reducing user costs and environmental damage.

More embodiments of the present disclosure can also achieve other advantageous technical effects not listed one by one, which may be partially described in the following text and can be expected and understood by those skilled in the art after reading the present disclosure.

BRIEF DESCRIPTION OF THE DRAWINGS

The drawings herein are incorporated into and form part of the specification to show embodiments that conform to the application and are used together with the specification to explain the rationale of the application. At the same time, these drawings and descriptions are not intended in any way to limit the scope of the idea of the application, but rather to illustrate the concept of the application for persons skilled in the art by reference to specific embodiments.

DETAILED DESCRIPTION

Figure 1:
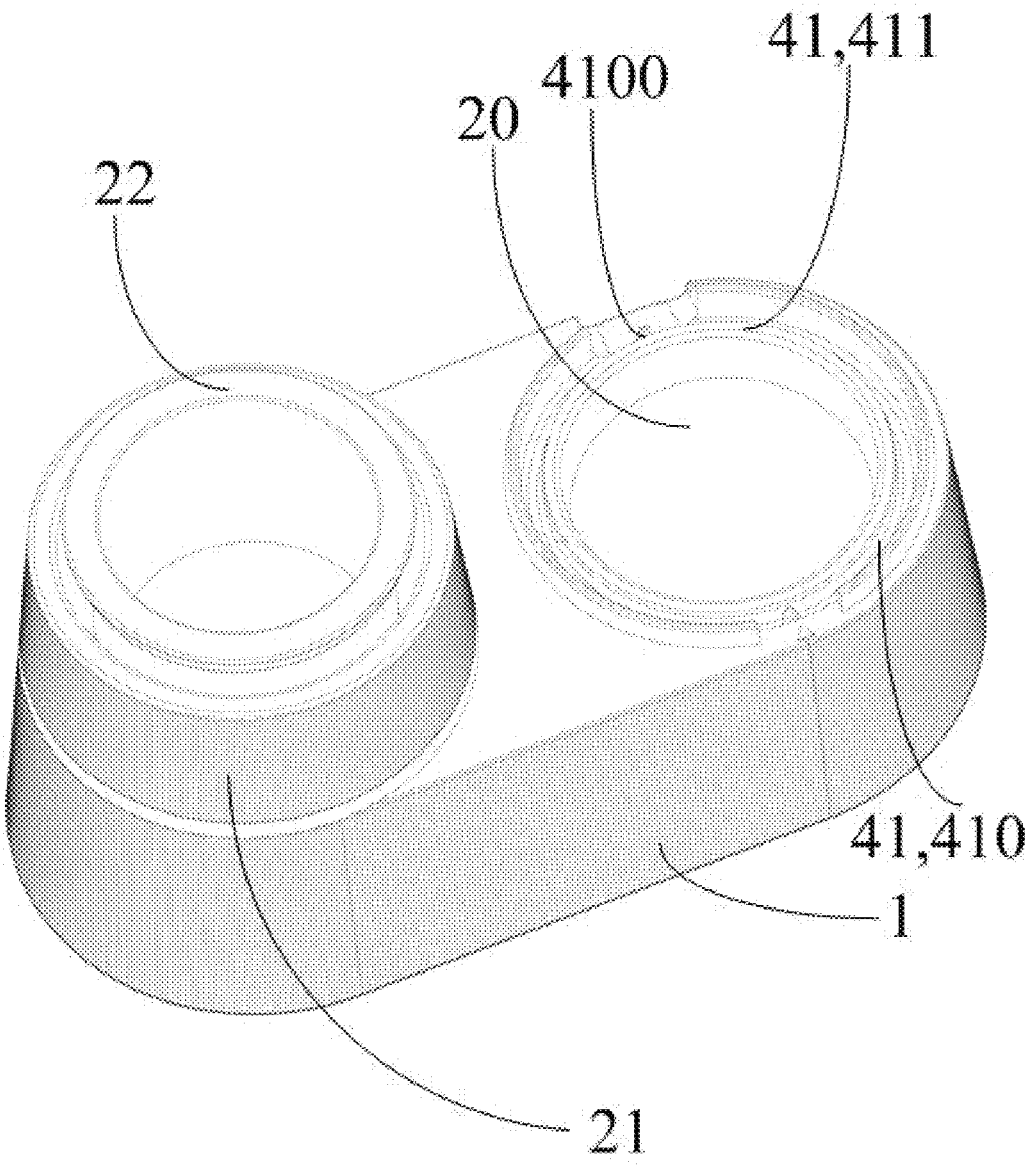
FIG. 1 shows a perspective view of the auxiliary device for the reusable coffee capsules of the present application.

In order to clarify the purpose, technical solution, and advantages of the embodiments of the present disclosure, the following will provide a clear and complete description of the technical solution in the embodiments of the present disclosure in conjunction with the accompanying drawings. Obviously, the described embodiments are one part of the embodiments of the present disclosure, not all of them. The components of the embodiments of the present disclosure described and illustrated in the accompanying drawings can be arranged and designed in various different configurations.

Therefore, the detailed description of the embodiments of the present disclosure provided in the accompanying drawings is not intended to limit the scope of the present disclosure, but only to represent selected embodiments of the present disclosure. Based on the embodiments in the present disclosure, all other embodiments obtained by ordinary skilled persons in this field without creative labor are within the scope of protection of the present disclosure.

It should be noted that similar labels and letters represent similar items in the following figures. Therefore, once an item is defined in one figure, it does not need to be further defined and explained in subsequent figures.

It should be understood that the terms "up", "down", "front", "back", "left", "right", "horizontal", etc. indicate the orientation or position relationship based on the orientation or position relationship shown in the drawings, only for the convenience of describing and simplifying the description of the present application, rather than indicating or implying that the device or component referred to must have a specific orientation, be constructed and operated in a specific orientation, and therefore cannot be understood as a limitation of the present application. In addition, the terms "first", "second", "third", etc. are only used to distinguish descriptions and cannot be understood as indicating or implying relative importance. In the description of the present disclosure, unless otherwise specified, the meaning of "multiple" refers to two or more.

As used in this application, the terms "installation", "connection", "connecting", "fixed" and other terms should be broadly understood, for example, they can be fixed connections, detachable connections, or integrated connections; It can be a mechanical connection or an electrical connection; It can be directly connected, or indirectly connected through an intermediate medium, or it can be an internal connection between two components. For ordinary technical personnel in this field, the specific meanings of the above terms in this application can be understood based on specific circumstances.

In the present disclosure, unless otherwise specified and limited, the first feature above or below the second feature may include direct contact between the first and second features, or may include contact between the first and second features through another feature between them instead of direct contact. Moreover, the first feature being "above", and "on" the second feature includes the first feature being directly above and diagonally above the second feature, or simply indicating that the first feature is horizontally higher than the second feature. The first feature being "below" include the first feature being directly below and diagonally below the second feature, or simply indicating that the first feature has a lower horizontal height than the second feature.

The embodiments of the present disclosure are described in detail below, and examples of the embodiments are shown in the accompanying drawings, where the same or similar reference numerals from beginning to end represent the same or similar elements or elements with the same or similar functions. The embodiments described below with reference to the accompanying drawings are exemplary and are only used to explain the present disclosure, and should not be understood as limiting the present disclosure.

Figure 5:
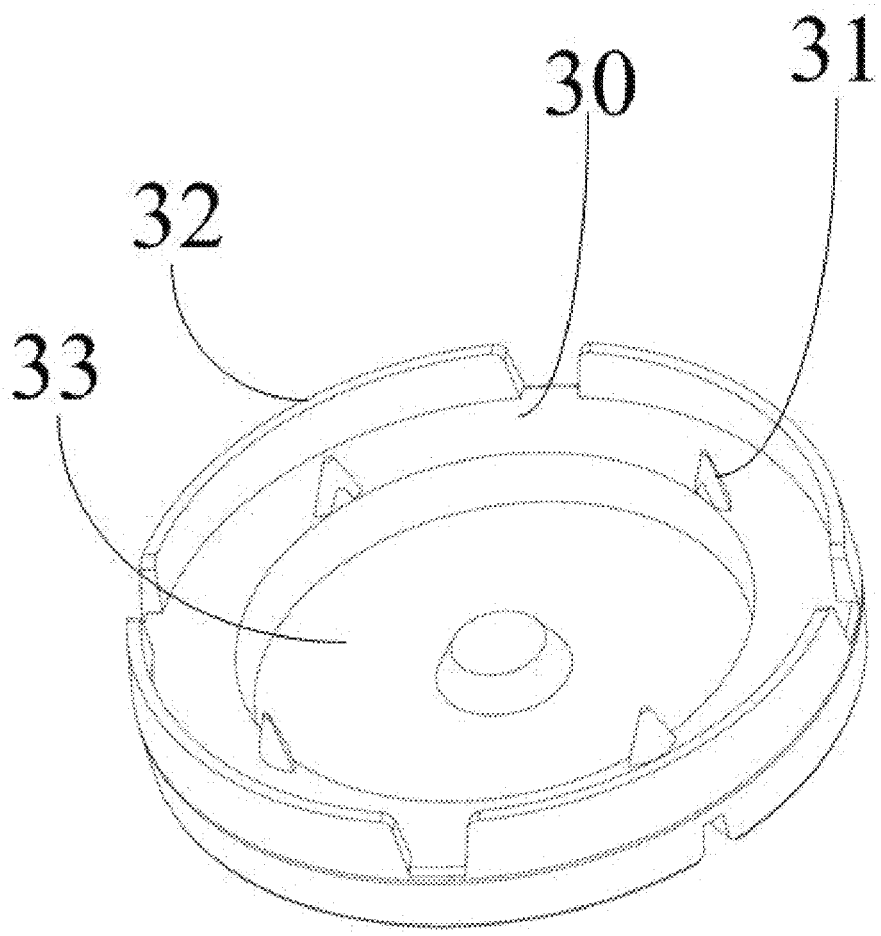
FIG. 5 shows a perspective view of the cutting unit of the auxiliary device for reusable coffee capsules in the present application.
Figure 6:
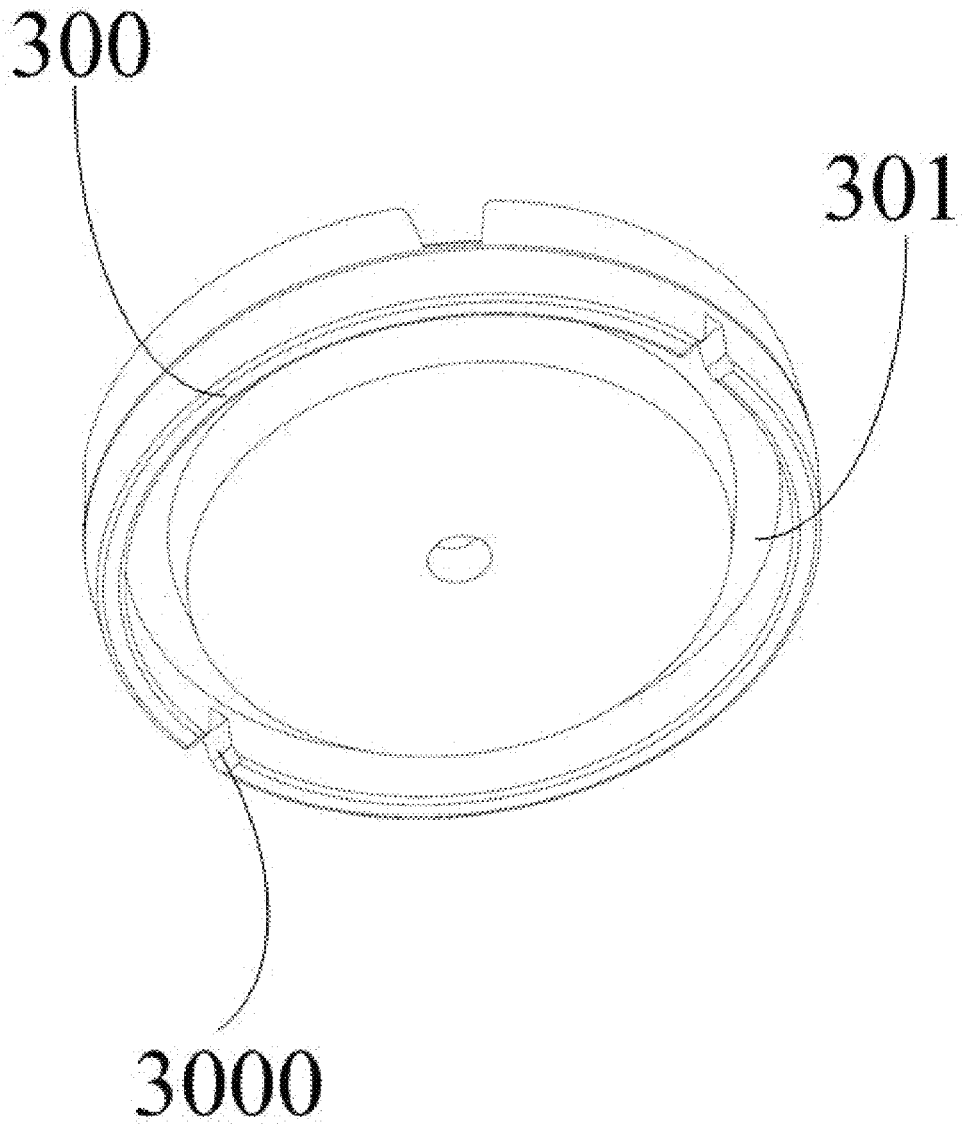
FIG. 6 shows another perspective view of the cutting unit of the auxiliary device for reusable coffee capsules in the present application.

FIG. 1 provides an auxiliary device for reusable coffee capsules, comprising: a base 1; a powder pressing unit comprising a capsule groove 20 arranged on the base 1, a funnel 21 detachably connected to the capsule groove 20, and a powder pressing cylinder 22 for compacting coffee powder; a film pressing unit; and a cutting unit, as shown in FIG. 5-6, the cutting unit includes a cutting body 30 and multiple cutting teeth 31 extending away from the cutting body 30 and spaced apart. The cutting teeth 31 are provided with tips for piercing the sealing film connected to the capsule. The cutting teeth 31 are arranged on an edge of a circle, which allows users to manually rotate the cutting unit or capsule to form a circular hole on the sealing film after piercing through it. Of course, the users can also install the cutting unit on the base 1 and form a circular hole on the sealing film by rotating the capsule.

As shown in FIG. 1, one or more capsule grooves 20 can be provided on the base 1. Correspondingly, multiple funnels 21 and powder cylinders 22 can also be provided.

Figure 3:
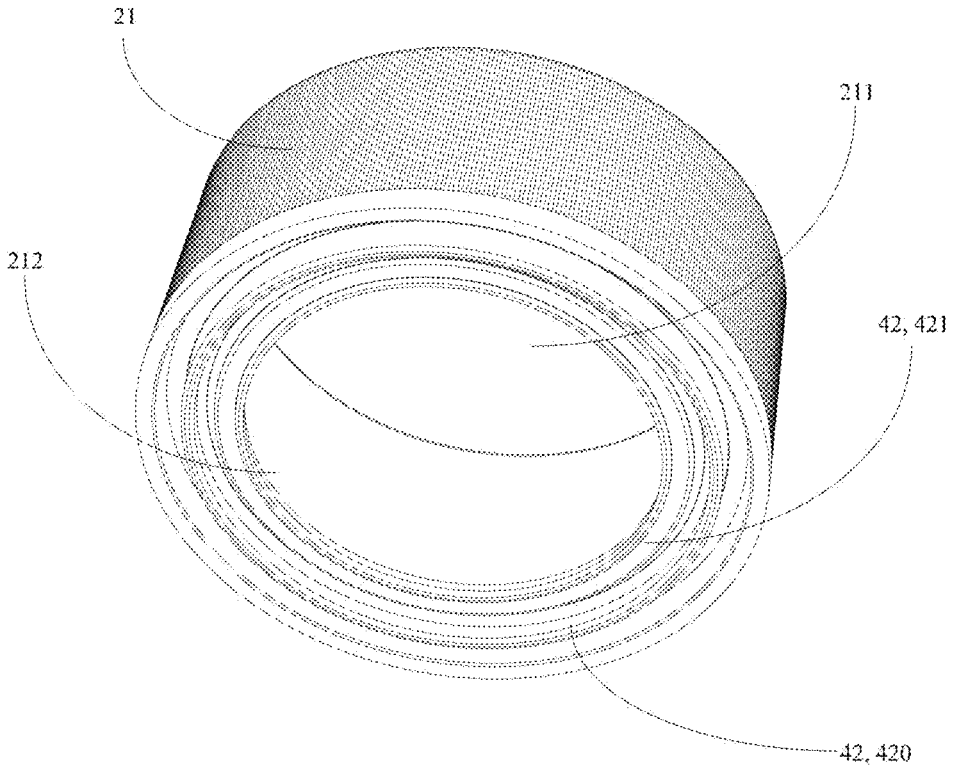
FIG. 3 shows the funnel of the auxiliary device for the reusable coffee capsules of the present application.

The film pressing unit is used to apply new sealing film onto the capsule after removing the sealing film. As shown in FIGS. 1 and 3, the film pressing unit may include a first film pressing structure 41 arranged on the base 1 and a second film pressing structure 42 arranged on the funnel 21 and matched with the first film pressing structure 41. As shown in FIG. 1, the edge of the capsule groove 20 is circular, and the first film pressing structure 41 is arranged around the capsule groove 20. During the film pressing process, the capsule is firstly placed in the capsule groove 20, and then a sealing film is placed on the opening of the capsule groove 20. At this time, the sealing film covers the first film pressing structure 41 and the capsule groove 20. Then, by installing and pressing the funnel 21, the sealing film is pressed onto the capsule by the second film pressing structure 42 of the funnel 21.

As shown in FIG. 1, the first film pressing structure 41 includes a first limiting groove 410 and a first convex surface 411 extending away from the base 1. As shown in FIG. 3, the second film pressing structure 42 includes a first limiting wing 420 that matches the first limiting groove 410 and a second convex surface 421 that is opposite to the first convex surface 411.

As shown in FIG. 3, the funnel 21 also includes a first opening 211 and a second opening 212 arranged opposite to the first opening 211. The first opening 211 and the second opening 212 are connected to the capsule groove 20. The inner diameter of the first opening 211 is larger than the inner diameter of the second opening 212.

Figure 4:
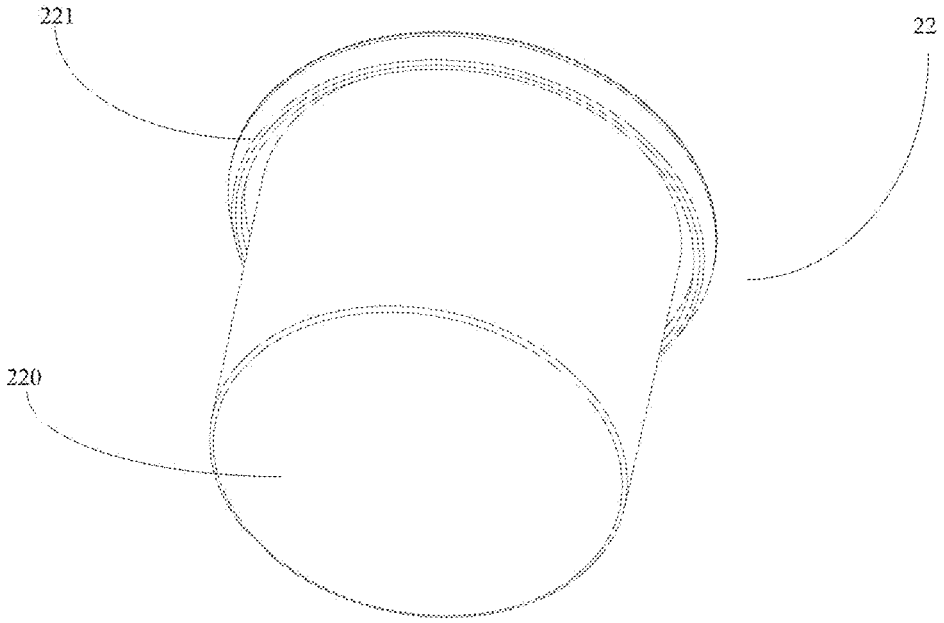
FIG. 4 shows the powder pressing cylinder of the auxiliary device for the reusable coffee capsules of the present application.

As shown in FIG. 4, the powder pressing cylinder 22 includes a powder pressing plane 220 and a limiting flange 221. The diameter of the powder pressing plane 220 is smaller than the inner diameter of the second opening 212. The diameter of the limiting flange 221 is smaller than the inner diameter of the first opening 211 and larger than the inner diameter of the second opening 212. In one embodiment, the difference between the diameter of the powder pressing plane 220 and the inner diameter of the second opening 212 is within the range of 1-3 mm.

As shown in FIG. 3, the second opening 212 is circular, and the second film pressing structure 42 is arranged around the second opening 212.

As shown in FIGS. 5 and 6, the cutting body 30 includes a second limiting wing 300 and a first avoidance groove 301. The first limiting groove 410 matches the second limiting wing 300, and the first convex surface 411 matches the first avoidance groove 301. The cutting unit also includes multiple positioning protrusions 32 spaced apart, which are arranged on an edge of a circle. Multiple positioning protrusions 32 are used to locate the sealing film and restrict its movement, making it easy for users to quickly position the capsule that needs to remove the sealing film on the cutting unit. When the user needs to cut the sealing film, they need to place the sealing film of the capsule on the cutting body 30. By setting multiple positioning protrusions 32, users can quickly find the location to place the sealing film.

As shown in FIG. 1, a first positioning column 4100 is also provided inside the first limit groove 410. As shown in FIG. 6, the second limiting wing 300 is also equipped with a first positioning hole 3000 that matches the first positioning column 4100. When the user installs the cutting unit on the base 1, the first positioning column 4100 is used to restrict the cutting unit from rotating.

Figure 2:
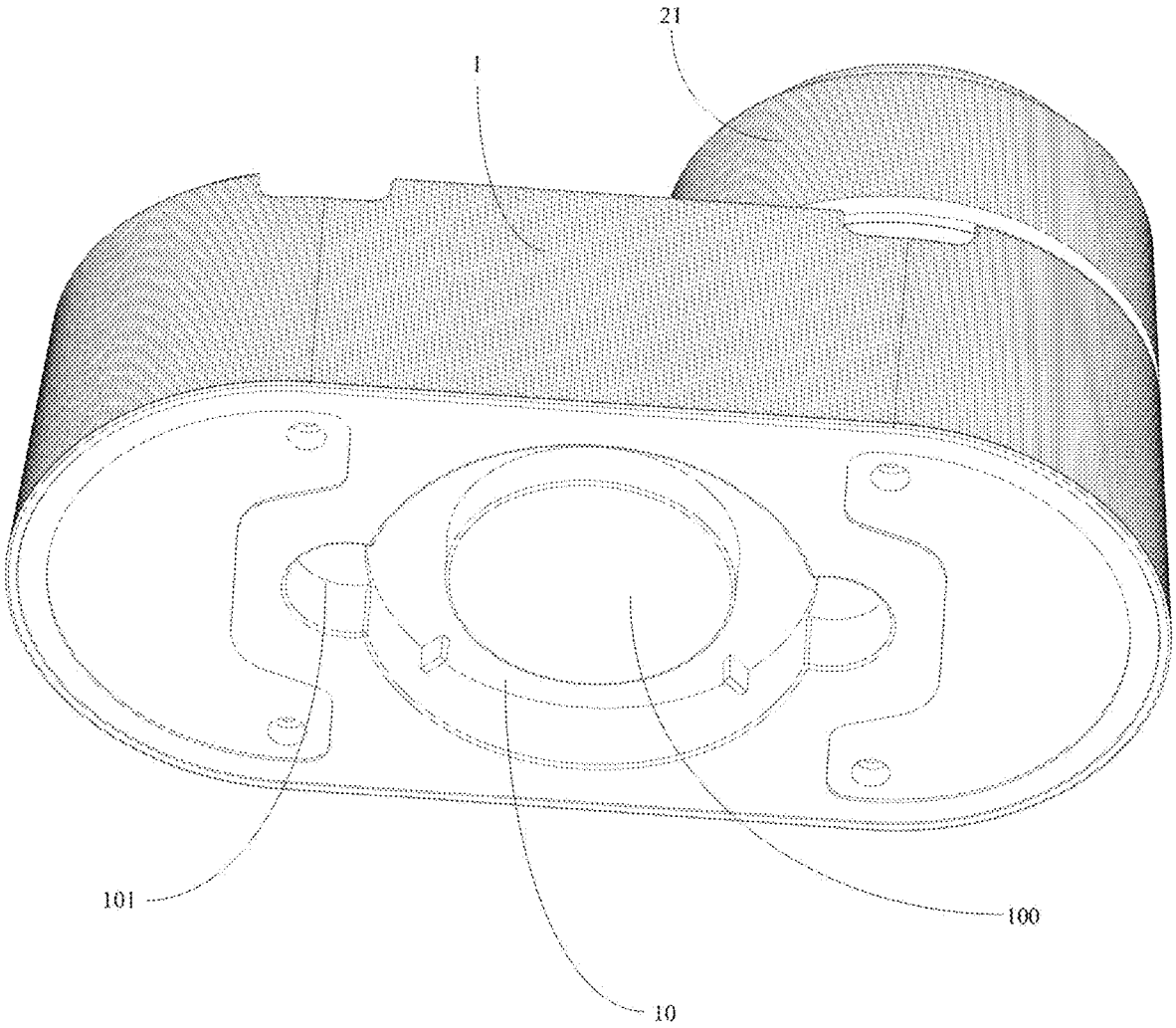
FIG. 2 shows another perspective view of the auxiliary device for the reusable coffee capsules of the present application.

As shown in FIG. 2, the base 1 is equipped with a storage groove 10 for accommodating the cutting unit, which can be set at the bottom of the base 1. The storage groove 10 is equipped with a third convex surface 100 and a first avoidance hole 101. As shown in FIG. 5, the cutting unit is equipped with a first groove 33 that matches the third convex surface 100. The storage groove 10 is equipped with a magnet, which is used to attract the third convex surface 100 and the first groove 33 together.

The usage process of this auxiliary device is as follows:

Firstly, installing the cutting unit on the base 1, then installing the capsule with sealing film on the cutting unit and rotating the capsule once until the sealing film is cut, and then discarding the coffee powder inside the capsule;

After placing the clean capsule in the capsule groove 20, installing the funnel 21 on the base 1, and pouring the coffee powder into the capsule through the funnel 21;

Installing the powder pressing cylinder 22 and pressing it down to compact the coffee powder in the capsule, then taking out the powder pressing cylinder 22 and the funnel 21;

Sticking a sealing film on the edge of the opening of the capsule and installing the funnel 21, pressing the funnel 21 to tightly press the sealing film onto the capsule, simultaneously, the capsule can be taken out for making coffee.

The above are only the preferred embodiments of the present disclosure and are not intended to limit the present disclosure. Any modifications, equivalent substitutions, and improvements made within the spirit and principles of the present disclosure shall be included in the scope of protection of the present disclosure.

What is claimed is:

1. An auxiliary device for reusable coffee capsules, comprising:

a base;

a powder pressing unit comprising a capsule groove arranged on the base, a funnel detachably connected to the capsule groove, and a powder pressing cylinder for compacting coffee powder;

a film pressing unit; and a cutting unit comprising a cutting body and multiple cutting teeth extending away from the cutting body, wherein the film pressing unit comprises a first film pressing structure arranged on the base and a second film pressing structure arranged on the funnel and configured to engage with the first film pressing structure, the first film pressing structure comprises a first limiting groove and a first convex surface extending away from the base, and the second film pressing structure comprises a first limiting wing configured to be received in the first limiting groove and a second convex surface arranged opposite to the first convex surface.

2. The auxiliary device for reusable coffee capsules according to claim 1, wherein the funnel further comprises a first opening and a second opening arranged opposite to the first opening, and the first opening and the second opening are connected to the capsule groove.

3. The auxiliary device for reusable coffee capsules according to claim 2, wherein an inner diameter of the first opening is greater than an inner diameter of the second opening.

4. The auxiliary device for reusable coffee capsules according to claim 3, wherein the powder pressing cylinder comprises a powder pressing plane and a limiting flange.

5. The auxiliary device for reusable coffee capsules according to claim 4, wherein a diameter of the powder pressing plane is smaller than the inner diameter of the second opening.

6. The auxiliary device for reusable coffee capsules according to claim 5, wherein the difference between the diameter of the powder pressing plane and the inner diameter of the second opening is within the range of 1-3 mm.

7. The auxiliary device for reusable coffee capsules according to claim 6, wherein an edge of the capsule groove is circular, and the first film pressing structure is arranged around the capsule groove.

8. The auxiliary device for reusable coffee capsules according to claim 7, wherein the second opening is circular, and the second film pressing structure is arranged around the second opening.

9. The auxiliary device for reusable coffee capsules according to claim 8, wherein the cutting teeth are arranged on an edge of a circle.

10. The auxiliary device for reusable coffee capsules according to claim 9, wherein the cutting body comprises a second limiting wing and a first avoidance groove.

11. The auxiliary device for reusable coffee capsules according to claim 10, wherein the first limiting groove is configured to receive the second limiting wing, and the first convex surface is configured to be received in the first avoidance groove.

12. The auxiliary device for reusable coffee capsules according to claim 11, wherein a first positioning column is further provided in the first limiting groove, and a first positioning hole configured to receive the first positioning column is further provided in the second limiting wing.

13. The auxiliary device for reusable coffee capsules according to claim 12, wherein the cutting unit further comprises multiple positioning protrusions spaced apart, and the multiple positioning protrusions are arranged on an edge of a circle.

14. The auxiliary device for reusable coffee capsules according to claim 13, wherein the base is provided with a storage groove for accommodating the cutting unit, and the storage groove is provided with a third convex surface and a first avoidance hole.

15. The auxiliary device for reusable coffee capsules according to claim 14, wherein the cutting unit is provided with a first groove that configured to receive the third convex surface.

16. The auxiliary device for reusable coffee capsules according to claim 15, wherein the storage groove is provided with a magnet for attracting the third convex surface and the first groove together.

17. The auxiliary device for reusable coffee capsules according to claim 16, wherein the storage groove is set at the bottom of the base.

* * * * *